US007165533B2

(12) United States Patent
Adachi et al.

(10) Patent No.: US 7,165,533 B2
(45) Date of Patent: Jan. 23, 2007

(54) INTERNAL COMBUSTION ENGINE

(75) Inventors: Noriyasu Adachi, Numazu (JP); Tetsuji Nagata, Kariya (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 11/208,888

(22) Filed: Aug. 23, 2005

(65) Prior Publication Data

US 2006/0037582 A1 Feb. 23, 2006

(30) Foreign Application Priority Data

Aug. 23, 2004 (JP) ..... 2004-242530
Oct. 21, 2004 (JP) ..... 2004-306935

(51) Int. Cl.
*F02B 3/00* (2006.01)
*F02B 3/04* (2006.01)

(52) U.S. Cl. ..... 123/431; 123/299

(58) Field of Classification Search ..... 123/431, 123/299, 672, 691, 692, 300, 304, 305
See application file for complete search history.

(56) References Cited

U.S. PATENT DOCUMENTS 5,291,865 A 3/1994 Sasaki
5,568,725 A * 10/1996 Uchikawa ..... 60/274
6,453,229 B1 * 9/2002 Ohkuma et al. ..... 701/109
2002/0134073 A1 9/2002 Nishiyama et al.

FOREIGN PATENT DOCUMENTS

| | | |
|---|---|---|
| JP | 02-153241 | 6/1990 |
| JP | 02 191819 | 7/1990 |
| JP | 04358717 | 11/1992 |
| JP | 06-323182 | 11/1994 |
| JP | 11-351041 | 12/1999 |
| JP | 2001-020837 | 1/2001 |

OTHER PUBLICATIONS

International Search Report, Int'l Appln. No. PCT/JP2005/015310.
Written Opinion of the International Searching Authority, Int'l Appln. No. PCT/JP2005/015310.

* cited by examiner

*Primary Examiner*—Mahmoud Gimie
(74) *Attorney, Agent, or Firm*—Kenyon & Kenyon LLP

(57) ABSTRACT

A reference injection quantity of fuel to be injected from a port injection valve and an in-cylinder injection valve as well as an injection ratio are determined based on an operation condition. A ratio between a feedback correction amount for port injection and a feedback correction amount for in-cylinder injection is set equal to a ratio of the reference injection quantity. If an injection quantity obtained as a result of addition of a correction amount is smaller than a minimum injection quantity of the injection valve, feedback correction is prohibited. Meanwhile, if the feedback correction amount is small, only the injection valve attaining a larger injection quantity is subjected to feedback correction.

8 Claims, 7 Drawing Sheets

22···FIRST AIR-FUEL RATIO SENSOR
23···SECOND AIR-FUEL RATIO SENSOR
31···PORT INJECTION VALVE
32···IN-CYLINDER INJECTION VALVE

22···FIRST AIR-FUEL RATIO SENSOR
23···SECOND AIR-FUEL RATIO SENSOR
31···PORT INJECTION VALVE
32···IN-CYLINDER INJECTION VALVE

INTERNAL COMBUSTION ENGINE

This nonprovisional application is based on Japanese Patent Applications Nos. 2004-242530 and 2004-306935 filed with the Japan Patent Office on Aug. 23, 2004 and Oct. 21, 2004, respectively, the entire contents of which are hereby incorporated by reference.

BACKGROUND OF THE INVENTION

1. Field of the Invention

The present invention relates to an internal combustion engine, and more particularly to an internal combustion engine including a port injection valve injecting a fuel into an intake port and an in-cylinder injection valve injecting a fuel into a combustion chamber.

2. Description of the Background Art

An internal combustion engine including a port injection valve injecting a fuel into an intake port and an in-cylinder injection valve injecting a fuel into a combustion chamber, in which the fuel is injected from the port injection valve and the in-cylinder injection valve at an injection ratio determined in accordance with an operation condition, that is, a double injection type internal combustion engine, has been developed. For example, Japanese Patent Laying-Open No. 2001-20837 discloses such an internal combustion engine.

In present days, when an internal combustion engine is used for a vehicle, in many cases, an air-fuel ratio sensor is provided in an exhaust pipe and a fuel injection quantity is subjected to feedback correction such that an air-fuel ratio is set to a prescribed value based on an output of the air-fuel ratio sensor. Here, it is the air-fuel ratio of exhaust gas generated as a result of combustion of the fuel in the combustion chamber that the air-fuel ratio sensor detects.

When two fuel injection valves inject the fuel, the air-fuel ratio as described above represents the air-fuel ratio of exhaust gas which is a mixture of exhaust gas generated as a result of combustion of the fuel injected from the port injection valve and exhaust gas generated as a result of combustion of the fuel injected from the in-cylinder injection valve. Therefore, a feedback correction amount calculated based on this air-fuel ratio is the sum of a correction amount for the fuel injected from the port injection valve and a correction amount for the fuel injected from the in-cylinder injection valve.

As such, in order to subject both fuel injection valves to feedback correction, an appropriate feedback correction amount for each fuel injection valve should be set. Otherwise, combustion fluctuation occurs, and a driver may feel uncomfortable or unpleasant.

According to the apparatus disclosed in Japanese Patent Laying-Open No. 2001-20837, however, feedback correction of the fuel injection quantity is neither mentioned nor disclosed.

In addition, though an apparatus according to Japanese Patent Laying-Open No. 2-153241 has two fuel injection valves, it is one fuel injection valve that is subjected to feedback correction. That is, this publication does not disclose a ratio between feedback correction amounts for the two injection valves.

SUMMARY OF THE INVENTION

In view of the problems described above, the present invention aims to optimize a feedback correction amount for each fuel injection valve when a fuel injection quantity is subjected to feedback correction based on an output from an air-fuel ratio sensor in an internal combustion engine having a port injection valve and an in-cylinder injection valve.

According to the present invention, there is provided an internal combustion engine including a port injection valve injecting a fuel into an intake port and an in-cylinder injection valve injecting a fuel into a combustion chamber, in which the fuel is injected from the port injection valve and the in-cylinder injection valve at a ratio determined in accordance with an operation condition, an air-fuel ratio of an exhaust gas is detected by an air-fuel ratio sensor, and a fuel injection quantity is subjected to feedback correction based on an output from the air-fuel ratio sensor. In the internal combustion engine, an injection quantity ratio between a port injection quantity and an in-cylinder injection quantity is calculated, and a ratio between a feedback correction amount for port injection and a feedback correction amount for in-cylinder injection is determined based on the calculated injection quantity ratio.

In the internal combustion engine configured as above, a ratio between the feedback correction amount for port injection and the feedback correction amount for in-cylinder injection is determined based on the injection quantity ratio between the port injection quantity and the in-cylinder injection quantity.

Preferably, a ratio between the feedback correction amount for port injection and the feedback correction amount for in-cylinder injection is set equal to the injection quantity ratio.

More preferably, if the feedback correction amount is small, feedback correction solely for the injection valve attaining larger injection quantity is carried out.

More preferably, when the injection quantity is equal to or smaller than a minimum injection quantity of an injection valve as a result of feedback correction, feedback correction for that injection valve is prohibited.

More preferably, in an operation region where knocking is likely, a ratio between the in-cylinder injection quantity and the port injection quantity is set in advance such that the in-cylinder injection quantity is larger than the port injection quantity. Each feedback correction amount is determined such that a difference between a ratio of the in-cylinder injection quantity and a ratio of the port injection quantity after addition of the feedback correction amount to total injection quantity is smaller than before addition of the feedback correction amount.

According to the invention described above, the feedback correction amount for in-cylinder injection and the feedback correction amount for port injection are determined based on the injection quantity ratio, whereby significant deviation from the injection quantity ratio is not likely. Therefore, occurrence of combustion fluctuation is prevented, and the driver does not feel uncomfortable or unpleasant.

According to another aspect of the present invention, there is provided an internal combustion engine including a port injection valve injecting a fuel into an intake port and an in-cylinder injection valve injecting a fuel into a combustion chamber, in which the fuel is injected from the port injection valve and the in-cylinder injection valve at a ratio determined in accordance with an operation condition, an air-fuel ratio of an exhaust gas is detected by an air-fuel ratio sensor, and a fuel injection quantity is subjected to feedback correction based on an output from the air-fuel ratio sensor. In the internal combustion engine, air-fuel ratio difference representing difference between a target air-fuel ratio and an actual air-fuel ratio is calculated. Based on the calculated air-fuel ratio difference, excessive/insufficient fuel in in-cylinder injection and excessive/insufficient fuel in port injection are calculated. The calculated excessive/insufficient fuel in in-cylinder injection is multiplied by in-cylinder injection feedback gain to calculate an in-cylinder injection correction amount, and the calculated excessive/insufficient fuel in port injection is multiplied by port injection feedback gain to calculate a port injection correction amount. The in-cylinder injection feedback gain and the port injection feedback gain are set separately.

The excessive/insufficient fuel obtained based on the air-fuel ratio difference as described above is divided into excessive/insufficient fuel in in-cylinder injection and excessive/insufficient fuel in port injection, which are multiplied by the in-cylinder injection feedback gain and the port injection feedback gain respectively so as to calculate the in-cylinder injection amount and the port injection correction amount respectively. Here, the in-cylinder injection feedback gain and the port injection feedback gain are set separately.

Preferably, total excessive/insufficient fuel is calculated based on the calculated air-fuel ratio difference, and the total excessive/insufficient fuel is divided into the excessive/insufficient fuel in in-cylinder injection and the excessive/insufficient fuel in port injection in accordance with a predetermined ratio.

More preferably, when air-fuel ratio difference representing difference between a target air-fuel ratio and an actual air-fuel ratio is obtained and excessive/insufficient fuel in in-cylinder injection and excessive/insufficient fuel in port injection are calculated based on the air-fuel ratio difference, delay in in-cylinder injection due to a distance between the in-cylinder injection valve and the air-fuel ratio sensor and delay in port injection due to a distance between the port injection valve and the air-fuel ratio sensor are taken into consideration, thereby attaining high accuracy.

According to the invention described above, feedback correction gain for in-cylinder injection and feedback correction gain for port injection are determined separately. Therefore, occurrence of combustion fluctuation is prevented, and the driver does not feel uncomfortable or unpleasant.

In particular, if delay in in-cylinder injection due to a distance between the in-cylinder injection valve and the air-fuel ratio sensor and delay in port injection due to a distance between the port injection valve and the air-fuel ratio sensor are taken into consideration when the air-fuel ratio difference representing difference between a target air-fuel ratio and an actual air-fuel ratio is obtained and excessive/insufficient fuel in in-cylinder injection and excessive/insufficient fuel in port injection are calculated based on the air-fuel ratio difference, high accuracy is attained.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

<First Embodiment>

Figure 1:
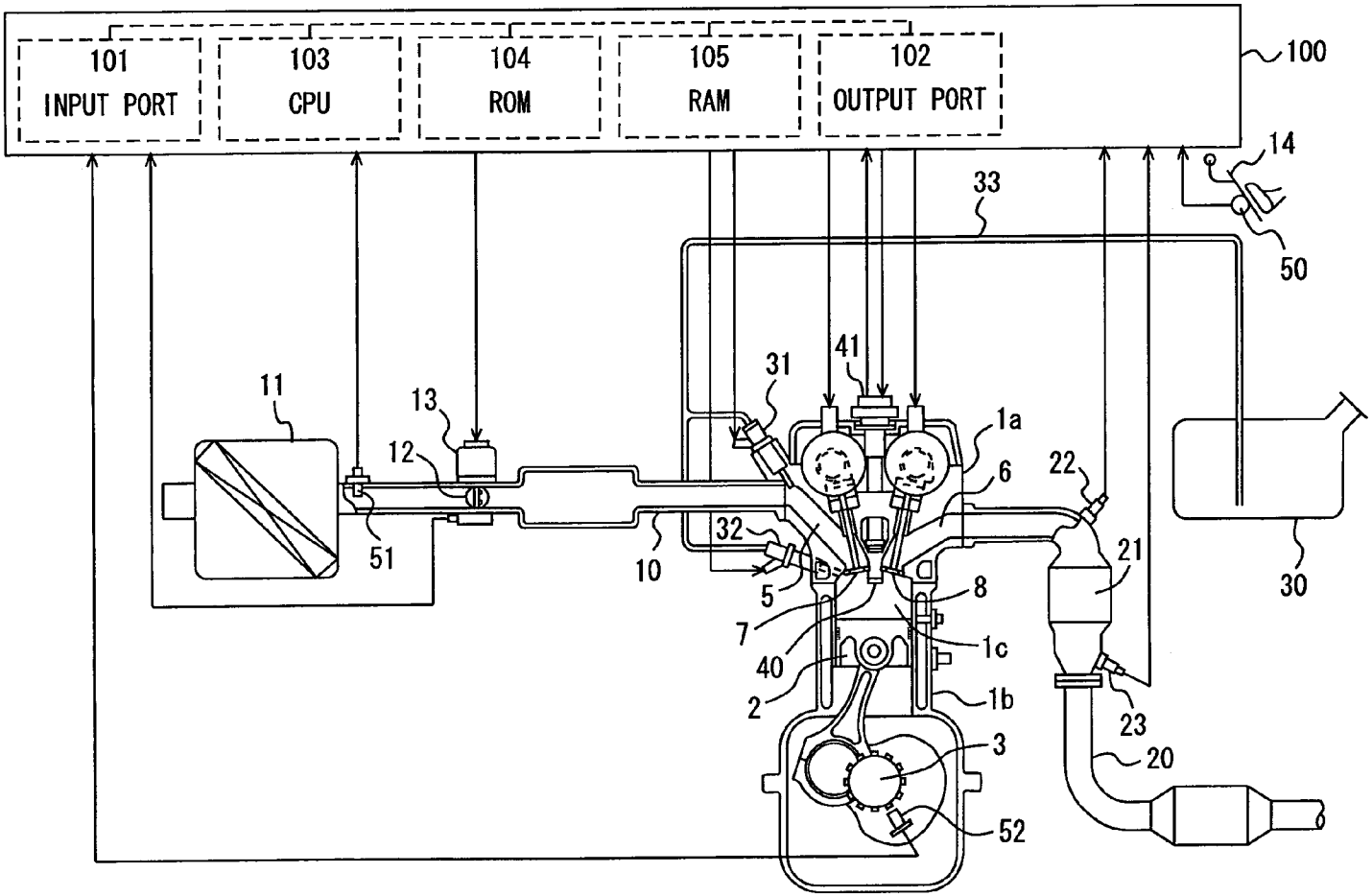
FIG. 1 shows a hardware structure of an embodiment of the present invention.

An embodiment of the present invention will be described hereinafter with reference to the drawings. FIG. 1 shows a hardware structure common to embodiments of the present invention.

A spark ignition type internal combustion engine 1 includes a cylinder head 1*a* and a cylinder block 1*b*. Cylinder head 1*a* includes an intake port 5, an exhaust port 6, an intake valve 7, an exhaust valve 8, and a spark plug 40. Spark plug 40 is supplied with a high-voltage current by a spark coil 41.

A piston 2 coupled to a crankshaft 3 carries out reciprocating motion within cylinder block 1*b*, so that a combustion chamber 1*c* is formed between piston 2 and cylinder head 1*a*. In addition, a crank angle sensor 52 is attached to cylinder block 1*b*, so that the engine speed is calculated based on a signal from crank angle sensor 52.

In FIG. 1, a port injection valve 31 for injecting the fuel into intake port 5 and an in-cylinder injection valve 32 for injecting the fuel into combustion chamber 1*c* are attached to cylinder head 1*a*. The fuel is sent and supplied to port injection valve 31 and in-cylinder injection valve 32 from a fuel tank 30 through a fuel pipe 33 by means of a fuel pump (not shown).

An intake pipe 10 is connected to intake port 5, and an air cleaner 11 is attached to an upstream end of intake pipe 10. An airflow meter 51 for detecting an intake air quantity is disposed immediately downstream of air cleaner 11. A throttle valve 12 is disposed downstream of airflow meter 51. Throttle valve 12 is driven by a throttle motor 13. Meanwhile, an accelerator pedal sensor 50 for detecting a degree of press-down of an accelerator pedal 14 is provided as an annex to accelerator pedal 14, so that an opening position of throttle valve 12 is modified by throttle motor 13 in accordance with the degree of press-down of accelerator pedal 14 detected by accelerator pedal sensor 50.

An exhaust pipe 20 is connected to exhaust port 6, and a three-way catalyst 21 is arranged in exhaust pipe 20. A first air-fuel ratio sensor 22 is arranged in the vicinity of the upstream side of three-way catalyst 21, and a second air-fuel ratio sensor 23 is arranged in the vicinity of the downstream side of the same. The exhaust gas generated in combustion chamber 1*c* flows through exhaust port 6 having a flow path opened and closed by exhaust valve 8, and is guided to exhaust pipe 20, through which the exhaust gas is purified by three-way catalyst 21 and thereafter emitted.

Then, according to the present invention, the injection quantity of the fuel injected from port injection valve 31 and in-cylinder injection valve 32 is subjected to feedback correction, in order to obtain a prescribed air-fuel ratio based on outputs from first air-fuel ratio sensor 22 and second air-fuel ratio sensor 23.

An electronic control unit 100 (hereinafter, referred to as ECU) is implemented by connecting an input port 101, an output port 102, a CPU 103, an ROM 104, an RAM 105, and the like to one another via a common bus. ECU 100 receives a signal detected by each sensor, and sends a control signal for control according to the present invention to each actuator.

Figure 2:
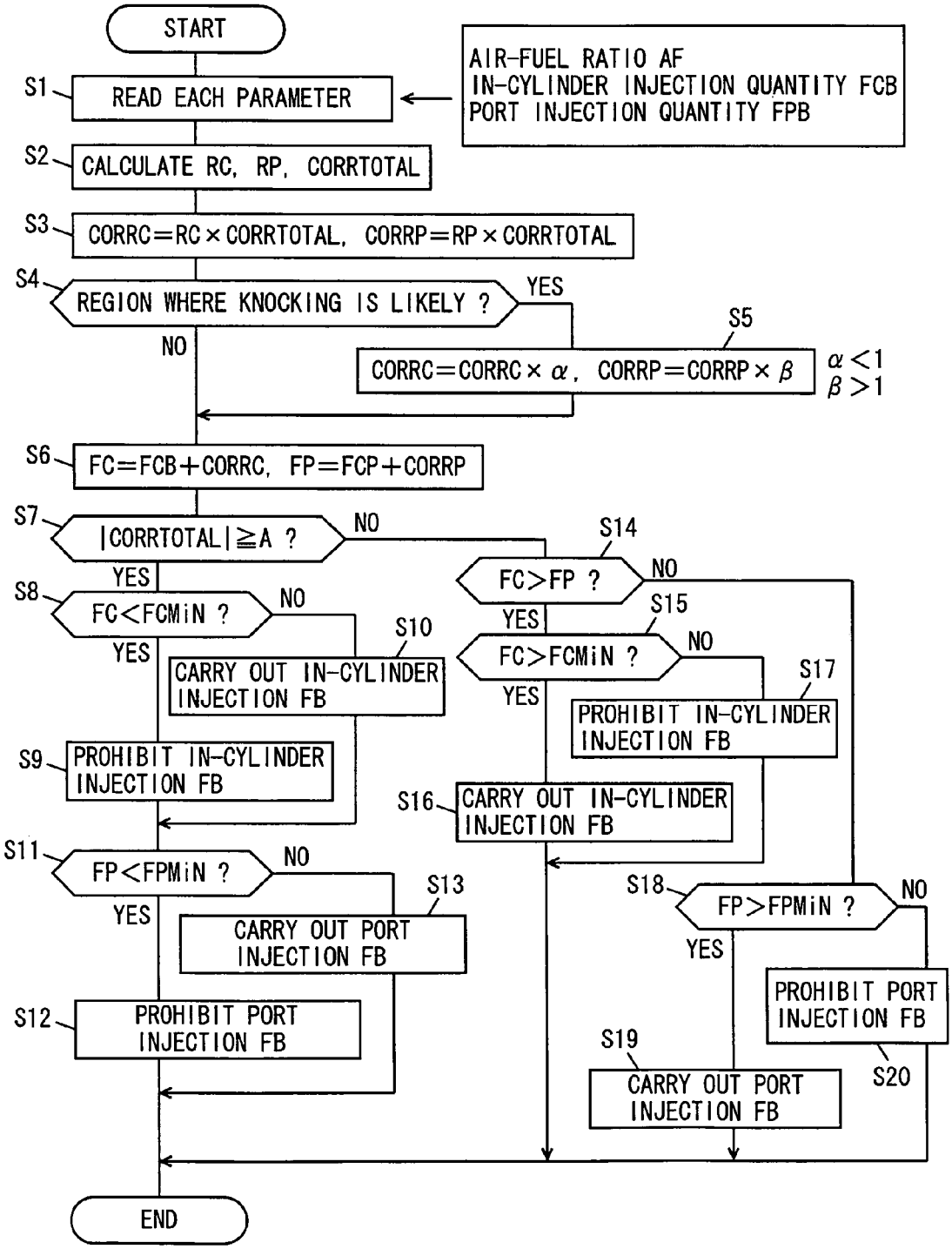
FIG. 2 is a flowchart of control in a first embodiment of the present invention.

In the following, feedback correction for fuel injection according to the present invention having a basic hardware structure as described above will be discussed with reference to the flowchart in FIG. 2.

Figure 3:
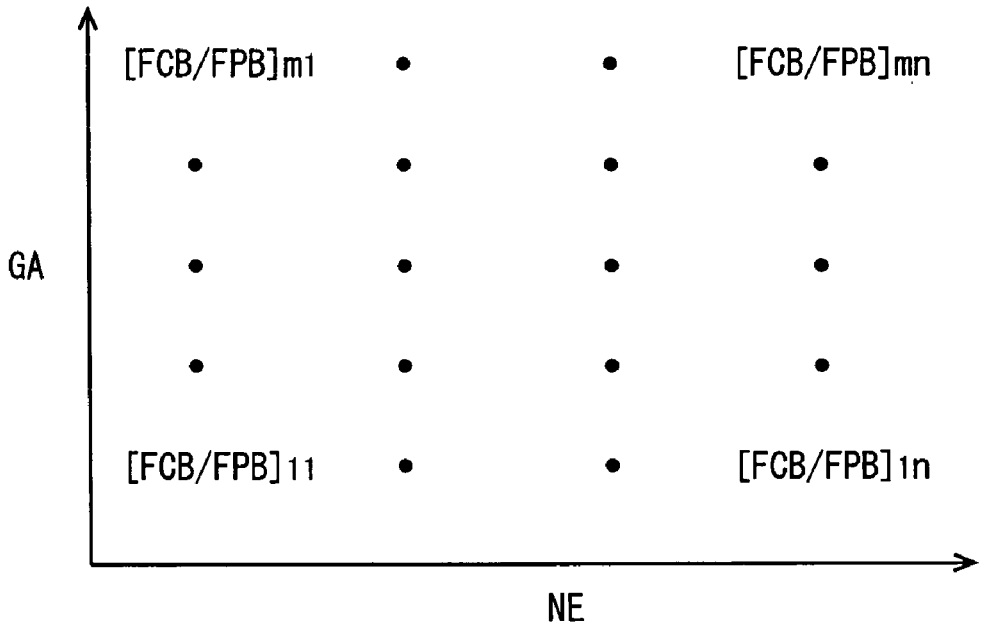
FIG. 3 shows a map of a reference in-cylinder injection quantity FCB and a reference port injection quantity FPB with respect to an engine speed and an intake air quantity.

At step S1, each parameter such as an air-fuel ratio AF, a reference in-cylinder injection quantity FCB, a reference port injection quantity FPB or the like is read. Reference in-cylinder injection quantity FCB and reference port injection quantity FPB are stored in a map as shown in FIG. 3, with respect to an engine speed NE and an air quantity GA.

At step S2, an in-cylinder injection ratio RC, a port injection ratio RP, and a total correction amount CORRTOTAL are calculated. In-cylinder injection ratio RC is calculated as follows: RC=FCB/(FCB+FPB). Port injection ratio RP is calculated as follows: RP=FPB/(FCB+FPB). Total correction amount CORRTOTAL is calculated based on a difference between an actual air-fuel ratio and a target air-fuel ratio and on the total injection quantity.

Here, reference in-cylinder injection quantity FCB and reference port injection quantity FPB may be obtained by storing the total injection quantity with respect to engine speed NE and air quantity GA, storing the injection ratio (only one is stored and the other can be obtained by subtracting one value from the total) with respect to engine speed NE and air quantity GA, and multiplying the injection ratio by the total injection quantity.

At step S3, in-cylinder injection ratio RC and total correction amount CORRTOTAL obtained at step S2 are multiplied to calculate an in-cylinder injection correction amount CORRC, and port injection ratio RP and total correction amount CORRTOTAL are multiplied to calculate a port injection correction amount CORRP.

At step S4, whether or not the operation state is in a region where knocking is likely is determined. If it is determined as NO, that is, if it is not determined that the operation state is in a region where knocking is likely, the process proceeds to step S6. If it is determined as YES, that is, if it is determined that the operation state is in a region where knocking is likely, step S5 is performed and thereafter the process proceeds to step S6.

At step S5, in-cylinder injection correction amount CORRC is multiplied by a predetermined coefficient $\alpha$ (<1) to obtain new in-cylinder injection correction amount CORRC, and port injection correction amount CORRP is multiplied by a predetermined coefficient $\beta$ (>1) to obtain new port injection correction amount CORRP.

At step S6, an in-cylinder injection quantity FC including the correction amount and a port injection quantity FP including the correction amount are calculated respectively as follows: FC=FCB+CORRC, FP=FPB+CORRP.

At step S7, whether or not the absolute value of CORRTOTAL is larger than a predetermined value A is determined. If it is determined as YES at step S7, the process proceeds to step S8. If it is determined as NO, the process proceeds to step S14.

If the process proceeds to step. S8, whether or not in-cylinder injection quantity FC including the correction amount is smaller than a minimum injection quantity FCMIN of the in-cylinder injection valve is determined at step S8. If it is determined as YES, the process proceeds to step S9, at which feedback correction for in-cylinder injection is prohibited. Thereafter, the process proceeds to step S11. If it is determined as NO, feedback correction for in-cylinder injection is performed at step S10 and the process proceeds to step S11.

At step S11, whether or not port injection quantity FP including the correction amount is smaller than a minimum injection quantity PMIN of the port injection valve is determined. If it is determined as YES, the process proceeds to step S12, at which feedback correction for port injection is prohibited. Thereafter, the process ends. If it is determined as NO, feedback correction for port injection is performed at step S13 and the process ends.

Meanwhile, if the process proceeds to step S14 as a result of determination as NO at step S7, whether or not in-cylinder injection quantity FC including the correction amount is larger than port injection quantity FP including the correction amount is determined at step S14. If it is determined as YES, the process proceeds to step S15. If it is determined as NO, the process proceeds to step S18.

If the process proceeds to step S15, whether or not in-cylinder injection quantity FC including the correction amount is larger than minimum injection quantity FCMIN of the in-cylinder injection valve is determined at step S15. If it is determined as YES, the process proceeds to step S16, at which feedback correction for in-cylinder injection is performed. Thereafter, the process ends. If it is determined as NO, feedback correction for in-cylinder injection is prohibited at step S17 and the process ends.

If the process proceeds to step S18, whether or not port injection quantity FP including the correction amount is larger than minimum injection quantity FPMIN of the port injection valve is determined at step S18. If it is determined as YES, the process proceeds to step S19, at which feedback correction for port injection is performed. Thereafter, the process ends. If it is determined as NO, feedback correction for port injection is prohibited at step S20 and the process ends.

The flowchart described above corresponds to claims as follows:

Step S3 corresponds to claims 1 and 2;

Steps S14 to S20 correspond to claim 3;

Steps S9, S12, S17, and S20 correspond to claim 4; and

Step S5 corresponds to claim 5.

Supplementary explanation for correspondence between claim 5 and step S5 will be provided.

In the region where knocking is likely, RC:RP, that is, the ratio between reference in-cylinder injection quantity FCB and reference port injection quantity FPB is set, for example, to 8:2. That is, the in-cylinder injection quantity is set to be larger than the port injection quantity. This is because knocking is less likely in in-cylinder injection.

Here, as shown in step S5, in-cylinder injection correction amount CORRC is multiplied by predetermined coefficient $\alpha$ (<1) to obtain new in-cylinder injection correction amount CORRC, and port injection correction amount CORRP is multiplied by predetermined coefficient $\beta$ (>1) to obtain new port injection correction amount CORRP. Then, the ratio between the in-cylinder injection quantity after addition of the feedback correction amount, i.e., FC=FCB+CORRC, and the port injection quantity after addition of the feedback correction amount, i.e., FP=FPB+CORRP, is modified such that a difference between the ratio of one injection quantity and the ratio of the other injection quantity to the total injection quantity is smaller than before correction. For example, the ratio that has been set to approximately 8:2 is modified to approximately 7:3.

<Second Embodiment>

In the following, feedback correction control in the second embodiment having a basic hardware structure as described above will be discussed with reference to the flowchart.

Figure 4:
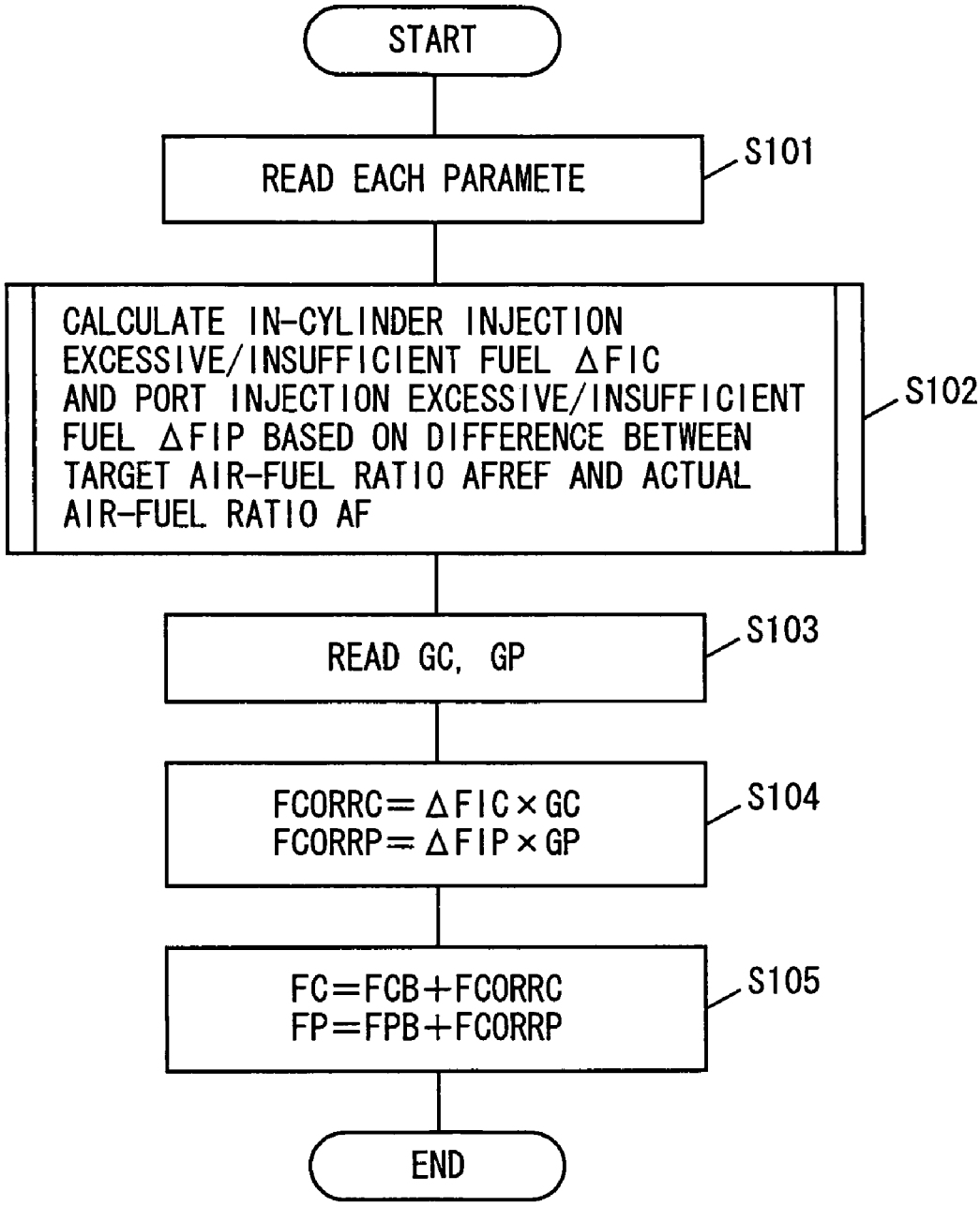
FIG. 4 is a flowchart of a main control routine in a second embodiment of the present invention.

FIG. 4 is a flowchart of a main routine in the second embodiment. At step S101, each parameter is read. In a sub routine at step S102, in-cylinder injection excessive/insufficient fuel ΔFIC and port injection excessive/insufficient fuel ΔFIP are calculated based on a difference between a target air-fuel ratio ΔFREF and an actual air-fuel ratio AF.

Figure 9:
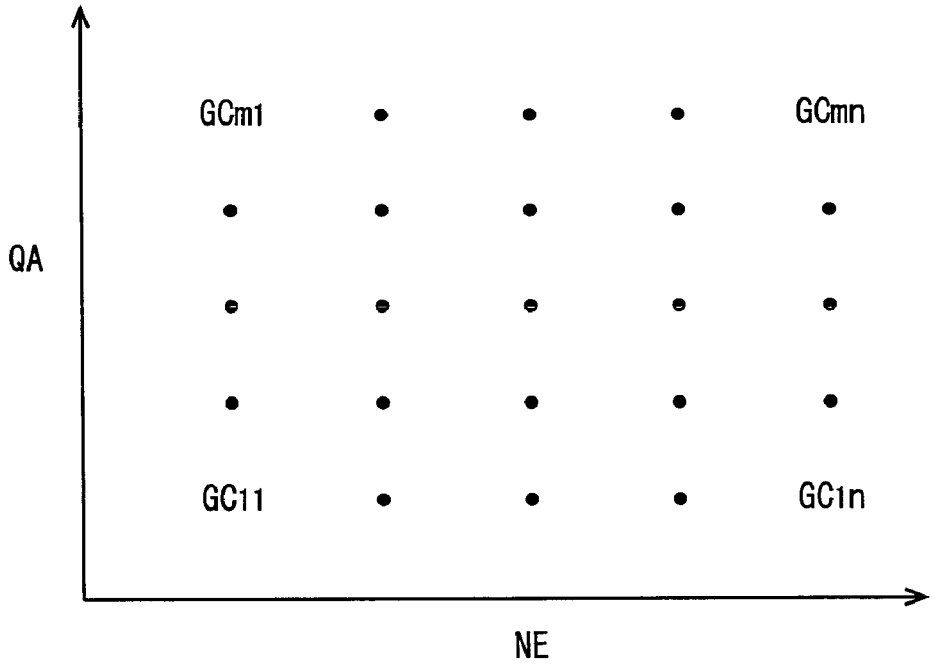
FIG. 9 shows a map of in-cylinder injection feedback gain GC with respect to an engine speed and an intake air quantity.
Figure 10:
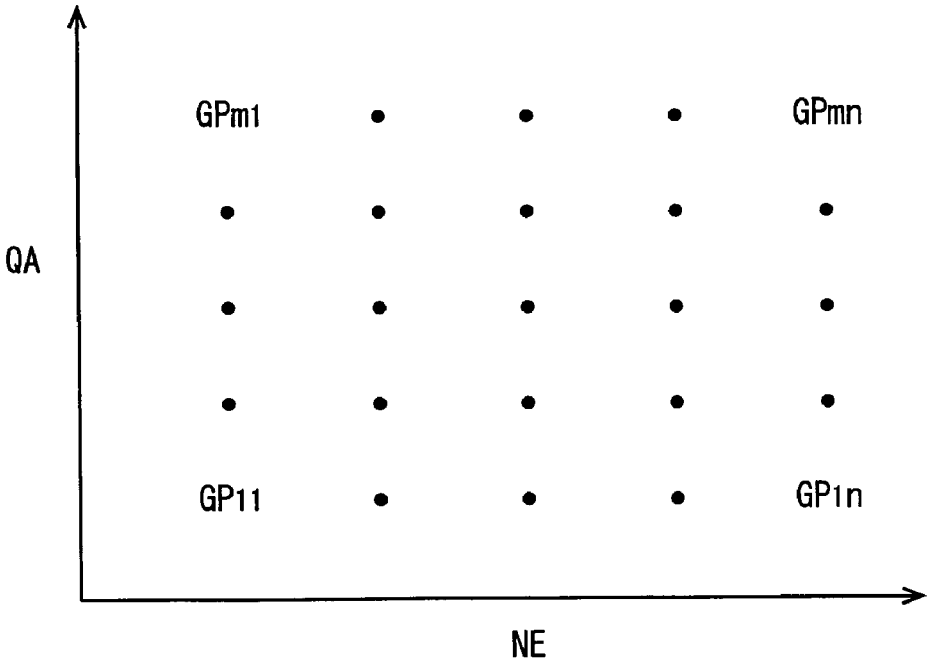
FIG. 10 shows a map of port injection feedback gain GP with respect to an engine speed and an intake air quantity.

At step S103, in-cylinder injection feedback gain GC under a current operation condition (intake air quantity and engine speed) and port injection feedback gain GP under the current operation condition (intake air quantity and engine speed) are read from maps shown in FIGS. 9 and 10 respectively.

The present invention is characterized by the use of separate feedback gains for in-cylinder injection and port injection. As correction adapted to each injection valve is thus performed, great fluctuation due to correction does not take place.

At step S104, in-cylinder injection excessive/insufficient fuel ΔFIC and port injection excessive/insufficient fuel ΔFIP obtained at step S102 are multiplied by in-cylinder injection feedback gain GC and port injection feedback gain GP obtained at step S103 respectively, to calculate an in-cylinder injection correction amount FCORRC and a port injection correction amount FCORRP respectively.

At step S105, in-cylinder injection correction amount FCORRC and port injection correction amount FCORRP calculated at step S104 are added to reference in-cylinder injection quantity FCB and reference port injection quantity FPB at step S105 respectively, to calculate in-cylinder injection quantity FC and port injection quantity FP respectively. Thereafter, fuel injection of calculated in-cylinder injection quantity FC and port injection quantity FP is performed.

Figure 5:
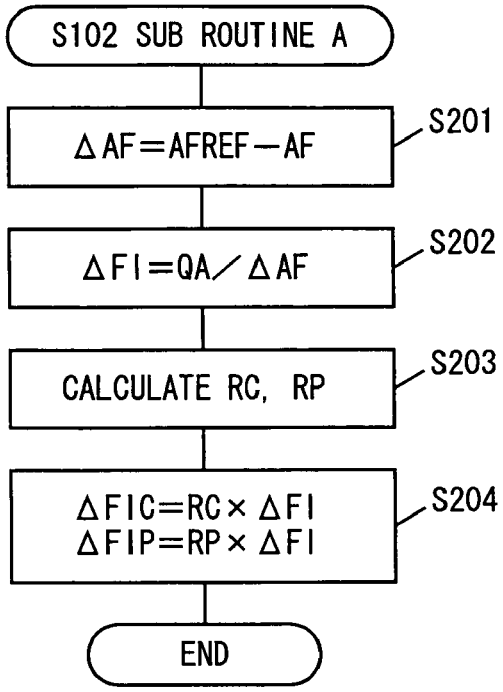
FIG. 5 is a flowchart of a sub routine in the second embodiment of the present invention.

FIG. 5 is a flowchart showing processing in the sub routine at step S102.

Initially, at step S201, air-fuel ratio difference ΔAF is calculated as follows: ΔAF=AFREF−AF. AFREF represents a target air-fuel ratio, and AF represents an actual air-fuel ratio. Actual air-fuel ratio AF represents a value detected by first air-fuel ratio sensor 22. At step S202, excessive/insufficient fuel ΔFI is calculated as follows: ΔFI=QA/ΔAF. Here, QA represents an intake air quantity detected by airflow meter 51.

Figure 7:
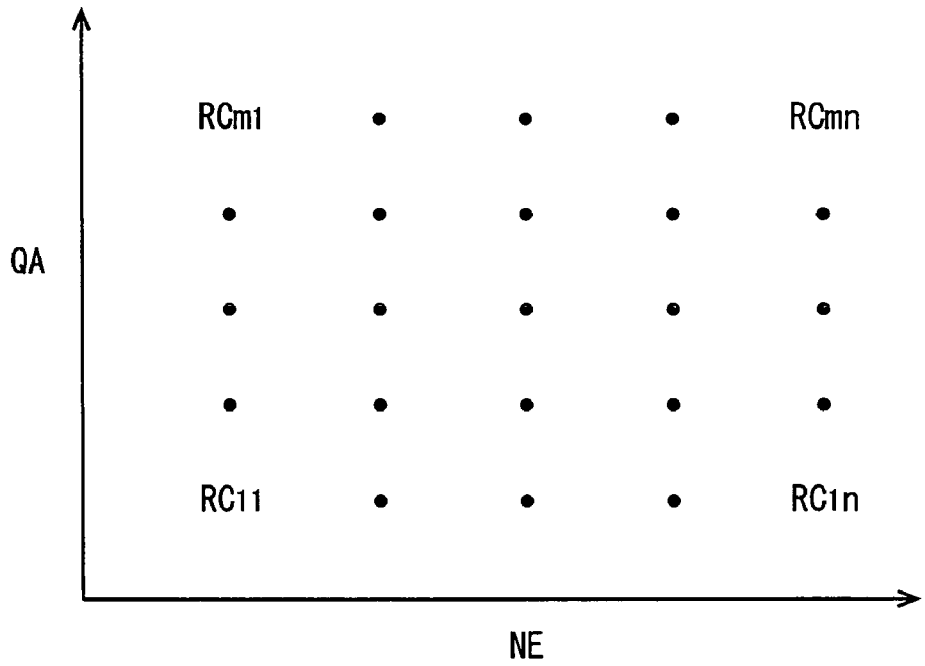
FIG. 7 shows a map of an in-cylinder injection ratio with respect to an engine speed and an intake air quantity.
Figure 8:
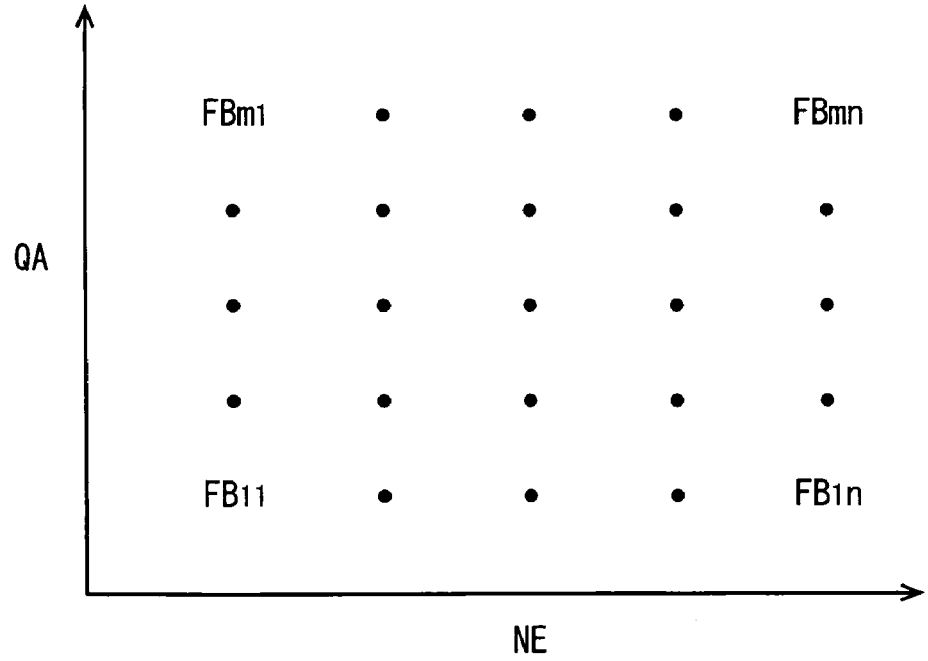
FIG. 8 shows a map of a total injection quantity with respect to an engine speed and an intake air quantity.

At step S203, in-cylinder injection ratio RC and port injection ratio RP are obtained. In-cylinder injection ratio RC is read from a map in FIG. 7, and port injection ratio RP is calculated as follows: RP=1−RC. Reference in-cylinder injection quantity FCB and reference port injection quantity FPB at step S105 are obtained by multiplying the map of total reference injection quantity FB stored in FIG. 8 by in-cylinder injection ratio RC and port injection ratio RP obtained in a manner as described above.

Alternatively, reference in-cylinder injection quantity FCB and reference port injection quantity FPB may be stored in advance. Then, in-cylinder injection ratio RC may be calculated as follows: RC=FCB/(FCB+FPB), and port injection ratio RP may be calculated as follows: RP=FPB/(FCB+FPB).

At step S204, excessive/insufficient fuel ΔFI obtained at step S202 is multiplied by in-cylinder injection ratio RC and port injection ratio RP obtained at step S203, to calculate in-cylinder injection excessive/insufficient fuel AFIC and port injection excessive/insufficient fuel ΔFIP.

<Third Embodiment>

Out of the exhaust gas detected by first air-fuel ratio sensor 22, the exhaust gas generated as a result of combustion of an air-fuel mixture resulted from mixing of the fuel injected by in-cylinder injection valve 32 with the intake air flowing therethrough is transported from in-cylinder injection valve 32 to first air-fuel ratio sensor 22 after the fuel is injected. Similarly, out of the exhaust gas detected by first air-fuel ratio sensor 22, the exhaust gas generated as a result of combustion of an air-fuel mixture resulted from mixing of the fuel injected by port injection valve 31 with the intake air flowing therethrough is transported from port injection valve 31 to first air-fuel ratio sensor 22 after the fuel is injected.

Figure 6:
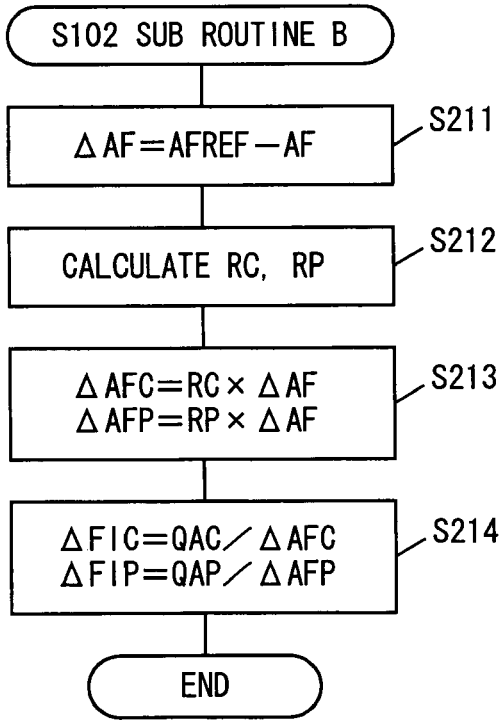
FIG. 6 is a flowchart of a sub routine in a third embodiment of the present invention.

Taking into consideration the above, in the third embodiment, the sub routine at step S102 is as shown in FIG. 6.

Step S211 is identical to step S201 in FIG. 5, and step S212 is identical to step S203 in FIG. 5

At step S213, air-fuel ratio difference ΔAF calculated at step S211 is multiplied by in-cylinder injection ratio RC and port injection ratio RP calculated at step S212, to divide air-fuel ratio difference ΔAF into an in-cylinder injection air-fuel ratio difference portion ΔAFC and a port injection air-fuel ratio difference portion ΔAFP.

At step S214, in-cylinder injection intake air quantity QAC and port injection intake air quantity QAP each taking into consideration the delay described above are divided by in-cylinder injection air-fuel ratio difference portion ΔAFC and port injection air-fuel ratio difference portion ΔAFP calculated at step S213 respectively, to calculate in-cylinder injection excessive/insufficient fuel ΔFIC and port injection excessive/insufficient fuel ΔFIP respectively.

In-cylinder injection intake air quantity QAC represents an intake air quantity at a time point backward from the time point of detection of air-fuel ratio AF by the delay time in the case of in-cylinder injection described previously, and port injection intake air quantity QAP represents an intake air quantity at a time point backward from the time point of detection of air-fuel ratio AF by the delay time in the case of port injection described previously.

The delay is different between in-cylinder injection and port injection. The different delay times are stored in advance as a map based on an operation state such as engine speed, load, and the like.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An internal combustion engine comprising a port injection valve injecting a fuel into an intake port and an in-cylinder injection valve injecting a fuel into a combustion chamber, in which the fuel is injected from the port injection valve and the in-cylinder injection valve at a ratio determined in accordance with an operation condition, an air-fuel ratio of an exhaust gas is detected by an air-fuel ratio sensor and a fuel injection quantity is subjected to feedback correction based on an output from the air-fuel ratio sensor; wherein an injection quantity ratio between a port injection quantity and an in-cylinder injection quantity is calculated, and a ratio between a feedback correction amount for port injection and a feedback correction amount for in-cylinder injection is determined based on the calculated injection quantity ratio.

2. The internal combustion engine according to claim 1, wherein a ratio between the feedback correction amount for port injection and the feedback correction amount for in-cylinder injection is set equal to the injection quantity ratio.

3. The internal combustion engine according to claim 1, wherein if the feedback correction amount is small, feedback correction solely for the injection valve attaining a larger injection quantity is carried out.

4. The internal combustion engine according to claim 1, wherein when the injection quantity is equal to or smaller than a minimum injection quantity of an injection valve as a result of feedback correction, feedback correction for that injection valve is prohibited.

5. The internal combustion engine according to claim 1, wherein in an operation region where knocking is likely, a ratio between the in-cylinder injection quantity and the port injection quantity is set in advance such that the in-cylinder injection quantity is larger than the port injection quantity, and each feedback correction amount is determined such that a difference between a ratio of the in-cylinder injection quantity and a ratio of the port injection quantity after addition of the feedback correction amount to total injection quantity is smaller than before addition of the feedback correction amount.

6. An internal combustion engine comprising a port injection valve injecting a fuel into an intake port and an in-cylinder injection valve injecting a fuel into a combustion chamber, in which the fuel is injected from the port injection valve and the in-cylinder injection valve at a ratio determined in accordance with an operation condition, an air-fuel ratio of an exhaust gas is detected by an air-fuel ratio sensor and a fuel injection quantity is subjected to feedback correction based on an output from the air-fuel ratio sensor; wherein air-fuel ratio difference representing difference between a target air-fuel ratio and an actual air-fuel ratio is obtained, and based on the air-fuel ratio difference, excessive/insufficient fuel in in-cylinder injection and excessive/insufficient fuel in port injection are calculated, the calculated excessive/insufficient fuel in in-cylinder injection is multiplied by in-cylinder injection feedback gain to calculate an in-cylinder injection correction amount, and the calculated excessive/insufficient fuel in port injection is multiplied by port injection feedback gain to calculate a port injection correction amount, and the in-cylinder injection feedback gain and the port injection feedback gain are set separately.

7. The internal combustion engine according to claim 6, wherein total excessive/insufficient fuel is calculated based on the calculated air-fuel ratio difference, and the total excessive/insufficient fuel is divided into the excessive/insufficient fuel in in-cylinder injection and the excessive/insufficient fuel in port injection in accordance with a predetermined ratio.

8. The internal combustion engine according to claim 6, wherein when the air-fuel ratio difference representing difference between a target air-fuel ratio and an actual air-fuel ratio is obtained and excessive/insufficient fuel in in-cylinder injection and excessive/insufficient fuel in port injection are calculated based on which air-fuel ratio difference, delay in in-cylinder injection due to a distance between the in-cylinder injection valve and the air-fuel ratio sensor and delay in port injection due to a distance between the port injection valve and the air-fuel ratio sensor are taken into consideration.

* * * * *

UNITED STATES PATENT AND TRADEMARK OFFICE

CERTIFICATE OF CORRECTION

PATENT NO. : 7,165,533 B2
APPLICATION NO. : 11/208888
DATED : January 23, 2007
INVENTOR(S) : Noriyasu Adachi et al.

It is certified that error appears in the above-identified patent and that said Letters Patent is hereby corrected as shown below:

| Column | Line | |
|---|---|---|
| 5 | 66 | After “step” delete “.”. |
| 6 | 11 | Change “PMIN” to --FPMIN--. |
| 7 | 14 | Change “ΔFREF” to --AFREF--. |
| 8 | 4 | Change “AFIC” to --ΔFIC--. |
| 8 | 15 | Change “resulted” to --resulting--. |

Signed and Sealed this

Tenth Day of July, 2007

JON W. DUDAS
*Director of the United States Patent and Trademark Office*